US005119875A

United States Patent [19]

Richard

[11] Patent Number: 5,119,875

[45] Date of Patent: Jun. 9, 1992

[54] HYDRAULICALLY ACTUATED LOCK SYSTEM

[75] Inventor: Ray A. Richard, Effurun, Nigeria

[73] Assignee: Otis Engineering Corporation, Dallas, Tex.

[21] Appl. No.: 638,323

[22] Filed: Jan. 7, 1991

Related U.S. Application Data

[63] Continuation-in-part of Ser. No. 436,645, Nov. 15, 1989, abandoned.

[51] Int. Cl.[5] ..... E21B 23/02

[52] U.S. Cl. ..... 166/212; 166/214

[58] Field of Search ..... 166/385, 212, 214, 217

[56] References Cited

U.S. PATENT DOCUMENTS

| | | | |
|---|---|---|---|
| 2,673,614 | 3/1954 | Miller | 166/214 |
| 4,465,132 | 8/1984 | Carroll et al. | 166/156 |
| 4,497,371 | 2/1985 | Lindsey, Jr. | 166/377 |
| 4,844,159 | 7/1989 | Airey et al. | 166/214 |
| 4,886,115 | 12/1989 | Leggetz et al. | 166/77 |

*Primary Examiner*—William P. Neuder
*Attorney, Agent, or Firm*—Roland O. Cox

[57] ABSTRACT

A system for sealing and anchoring reeled tubing in a landing nipple in well tubing. An hydraulically actuated lock mandrel having a locator is connected on the reeled tubing and lowered inside the tubing and into the landing nipple. The lock mandrel sealingly engages the landing nipple and the locator stops downward movement of the lock mandrel in the landing nipple. Pressure applied in the reeled tubing actuates the lock mandrel to lock and anchor the reeled tubing in the landing nipple. On sufficient reduction of pressure in the reeled tubing, the lock mandrel automatically unlocks from the landing nipple. Two embodiments of the lock mandrel are disclosed, each utilizing a different type of locator.

4 Claims, 5 Drawing Sheets

HYDRAULICALLY ACTUATED LOCK SYSTEM

This application for patent is a continuation-in-part of my copending U.S. patent application Ser. No. 07/436,645, filed Nov. 15, 1989 now abandoned.

BACKGROUND OF THE INVENTION

This invention relates to a lock system used in earth wells for locating, sealing and connecting or anchoring smaller well tubing to a landing nipple in larger well tubing.

A considerable number of patents have been obtained on lock systems and apparatus useful in earth wells. These systems utilize a landing nipple in the larger well tubing, a lock mandrel with seals and a landing nipple locator device connected to the lock mandrel. A well flow control device is often connected on the lock mandrel or locator. The landing nipple has a bore for sealably receiving the lock mandrel and in which the locator device can locate and the lock mandrel may be operated to lock. Examples of systems utilizing mechanically actuated lock mandrels installed on wireline are disclosed in U.S. Pat. Nos. 3,208,531 to Jack W. Tamplen; 4,396,601 to Jack W. Tamplen et al; 4,164,977 to Henry P. Arendt et al; 4,540,048 to Imre I. Gazda; and 4,745,974 to Brian D. Higgins.

U.S. Pat. No. 4,844,159 to Airey discloses a mechanically operated locking mechanism installed on wireline.

U.S. Pat. No. 4,886,115 to Leggett and Kitney covers a pressure containing wireline safety mechanism having an inner housing releasably retained in the mechanism. The inner housing is provided with a hydraulically actuated wireline cutter and a valve which closes to prevent upward flow through the inner housing after the wireline is cut and removed.

U.S. Pat. No. 4,465,132 to Carroll and Pearce covers a well system and hydraulically actuated tool stopping device that stops tools moving in well flow conductors on pressurizing fluid in a control line connected to the stopping device. The stopping device automatically operates to not stop tools on reduction of control pressure.

U.S. Pat. No. 4,497,371 covers a retrievable landing assembly which sealably engages and is hydraulically actuated to releasably latch in a receptacle. A ratchet mechanism is provided to lock the landing assembly latched in the receptacle. The ratchet mechanism must be sheared to unlatch the landing assembly from the receptacle.

SUMMARY OF THE INVENTION

The present invention discloses a lock system including selective and/or nonselective landing nipples in a larger well tubing lock mandrel which is connected to smaller reeled tubing and lowered into the well tubing to locate and seal in the desired landing nipple and be hydraulically actuated to lock, and anchor the reeled tubing to the landing nipple. Two embodiments of the invention lock mandrel are disclosed, one utilizes a selective locator device for locating in selective type landing nipples and the other utilizes a nonselective or "no-go" locator for locating in nonselective type landing nipples. Each lock mandrel has seals and locking lugs and a selective locator for selective landing nipples having profiled selector keys or a no-go locator for nonselective landing nipples. The selective landing nipples utilized in this invention have profiled grooving engageable by key selective locator devices only and are disclosed in U.S. Pat. No. 2,673,614 to Ira A. Miller, which is incorporated herein for reference. The key selective locator device used in the present invention system employs the keys of the Miller patent and operates in the same manner to locate only in "selected" landing nipples having compatible profiled grooving. The nonselective locator device used is the no-go ring shown in illustration MS 251 on page 117 of "general Sales Catalog" OEC 5338, a publication of Otis Engineering Corporation, P.O. Box 819052, Dallas, Tex. 75381-9052. The compatible nonselective landing nipple is the landing nipple of illustration MS 250 also shown on page 117, which is also incorporated herein for reference.

The nonselective landing nipple and/or selective landing nipples are connected at the proper level in well tubing and tubing is lowered into the well. Each nipple has a locking groove, a seal bore and a nonselective locator shoulder or profiled grooving for a selective locator. A shoulder is required in a nonselective landing nipple to stop down travel of the nonselective locator when used on the lock mandrel. This shoulder causes a reduction in the inside diameter of the landing nipple, which is highly undesirable as maximum flow through the landing nipple is reduced.

The selective landing nipple does not have a restricting internal shoulder and does not restrict flow through. When the selective key type locator is used on the lock mandrel, any one of a number of selective landing nipples in well tubing may be "selected" for locating in by equipping the selective locator with keys that will engage only the compatible profiled grooving in one of the selective landing nipples.

The lock mandrel and appropriate locator are connected to and lowered into well tubing on smaller continuous tubing reeled from a drum. After the lock mandrel and locater are moved downwardly through the well tubing and into the landing nipple, seals on the lock mandrel sealingly engage the landing nipple seal bore and downward travel of the lock mandrel and reeled tubing are stopped by either locator positioning the lock mandrel locking lugs adjacent the locking groove in the landing nipple. The lock mandrel may now be locked in the landing nipple by applying pressure to the reeled tubing at surface. The pressure in the lock mandrel acts to move a piston downwardly, which compresses a coil spring and moves an expander to cam leaf springs on which are mounted lugs outwardly, moving the lugs into the locking groove. Increased pressure in the reeled tubing moves the piston and expander further downwardly positioning a locking surface on the expander insider the lugs to lock them in outward position in the locking groove, connecting the lock mandrel and reeled tubing in the landing nipple. When pressure in the reeled tubing and lock mandrel is reduced sufficiently, the coil spring automatically extends moving the mandrel piston and expander upwardly from inside the lugs unlocking the lock mandrel from the landing nipple and permitting the leaf springs to move the lugs inwardly from the nipple locking groove.

DESCRIPTION OF THE PREFERRED EMBODIMENTS

Figure 1A:
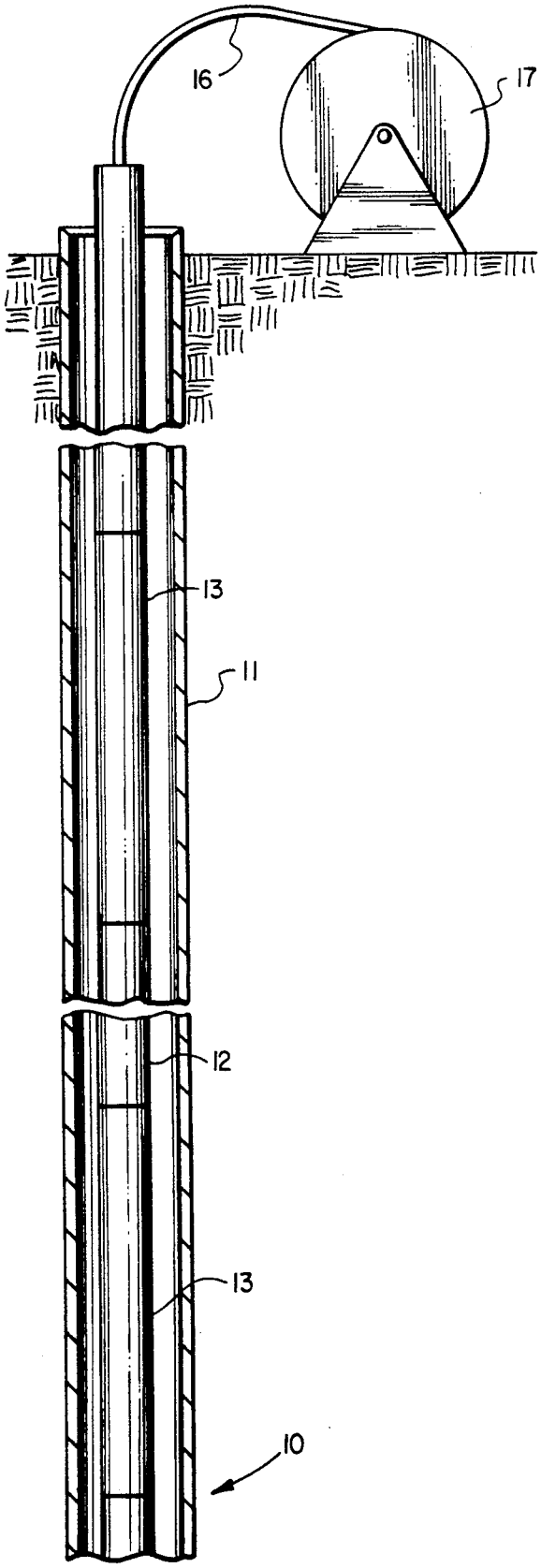
FIGS. 1A and 1B together are a schematic drawing of a well utilizing the lock system and hydraulically operated lock mandrel with selective locator of this invention.
Figure 1B:
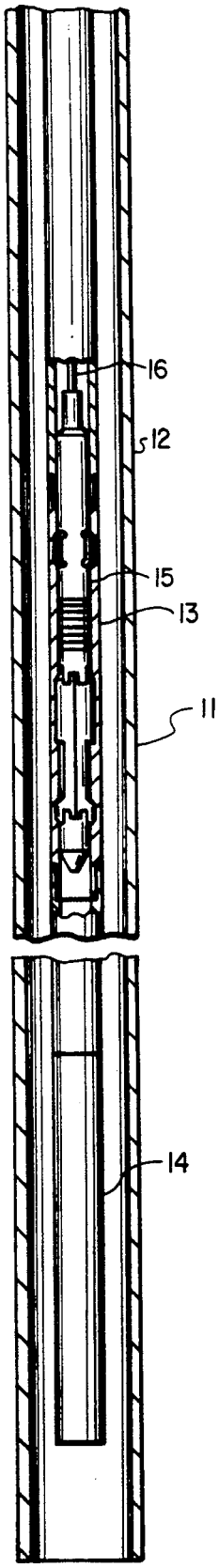

In FIG. 1, an earth well 10 is shown having casing 11 and a tubing string 12. Connected in the tubing string are a number of selective landing nipples 13 and a nonselective landing nipple 14. Each selective landing nipple has a locking groove 13*a*, a seal bore 13*b* and profiled locator grooving 13*c* (see FIG. 5). The nonselective landing nipple has a locking groove 14*a*, a seal bore 14*b* and a locator shoulder 14*c* (see FIG. 6).

Figure 6:
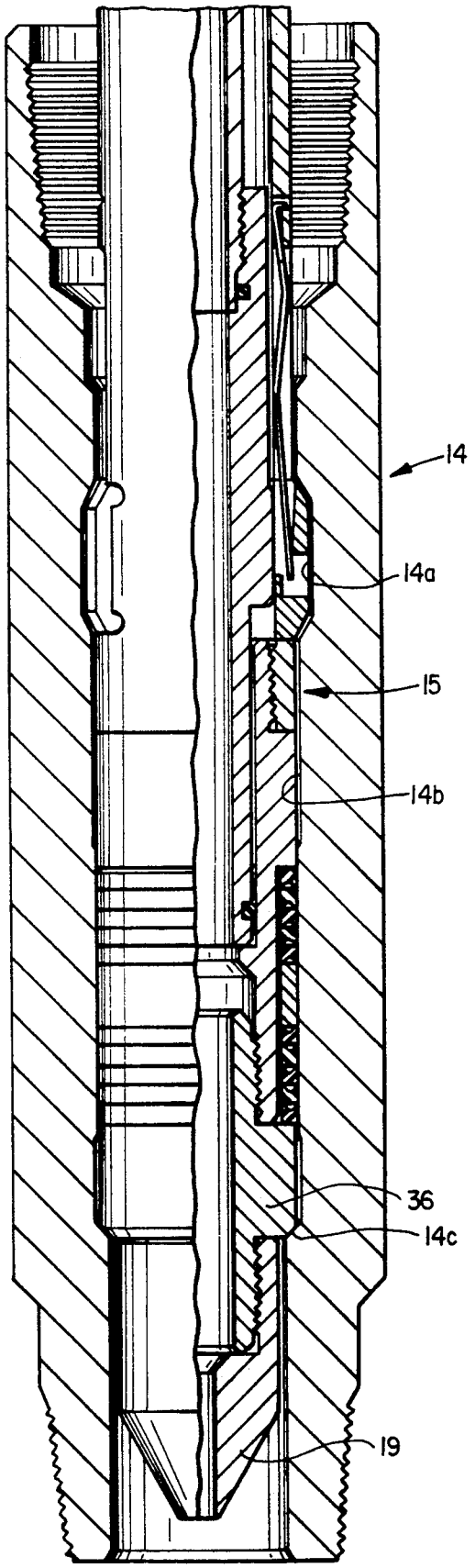
FIG. 6 is a fragmentary drawing in section showing the lower portion of the invention lock mandrel with a nonselective locator located, sealingly engaged and locked in a nonselective landing nipple.

FIG. 1 shows the hydraulically actuated lock mandrel 15 of this invention has been connected to small tubing 16 reeled on drum 17 and lowered into the tubing. The downward movement of the lock mandrel has been stopped by a selective locator 18 on the lock mandrel and the lock mandrel has sealingly engaged and has been hydraulically actuated to lock in a selected landing nipple, connecting the lock mandrel and anchoring reeled tubing in the landing nipple. FIG. 6 shows downward movement of lock mandrel 15 has been stopped by nonselective no-go ring locator 36 engaging shoulder 14*c* in nonselective landing nipple 14. The lock mandrel is sealingly engaged and has been hydraulically actuated to lock in the nonselective landing nipple anchoring the reeled tubing.

Figure 2A:
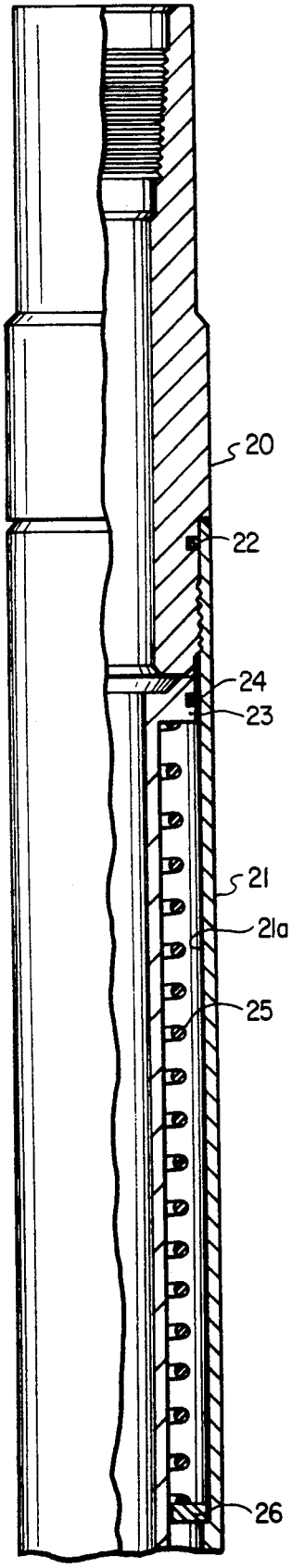
FIGS. 2A, 2B and 2C together are a half sectioned drawing in elevation of the hydraulically actuated lock mandrel of this invention, shown with a selective locator device connected on the lock mandrel lower end.
Figure 2B:
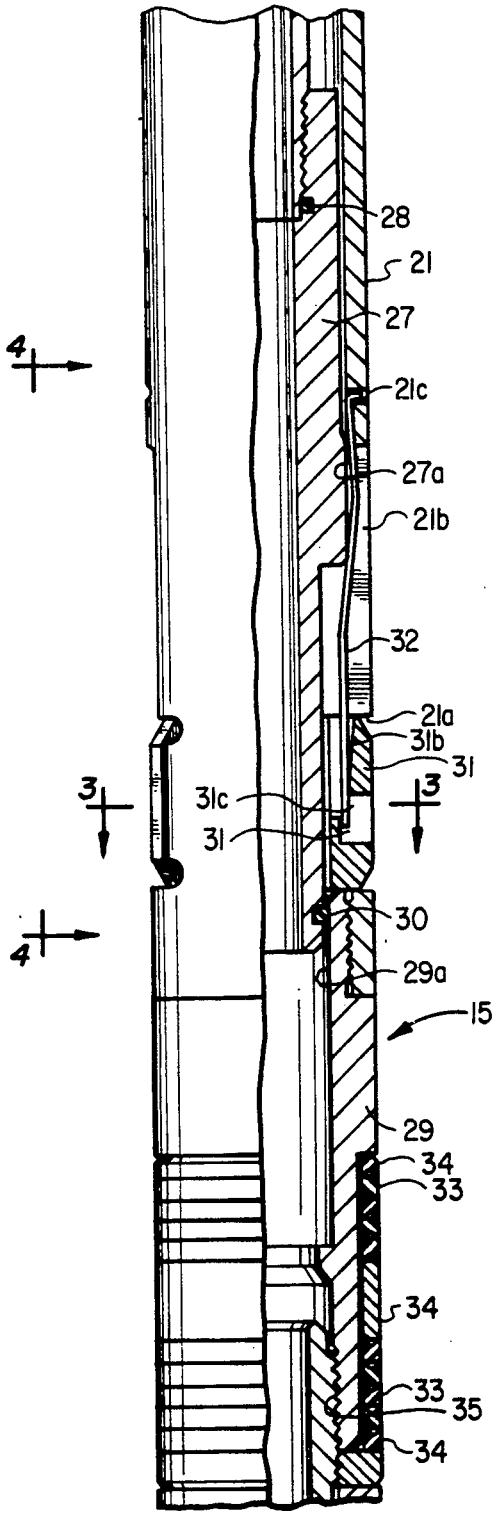
Figure 2C:
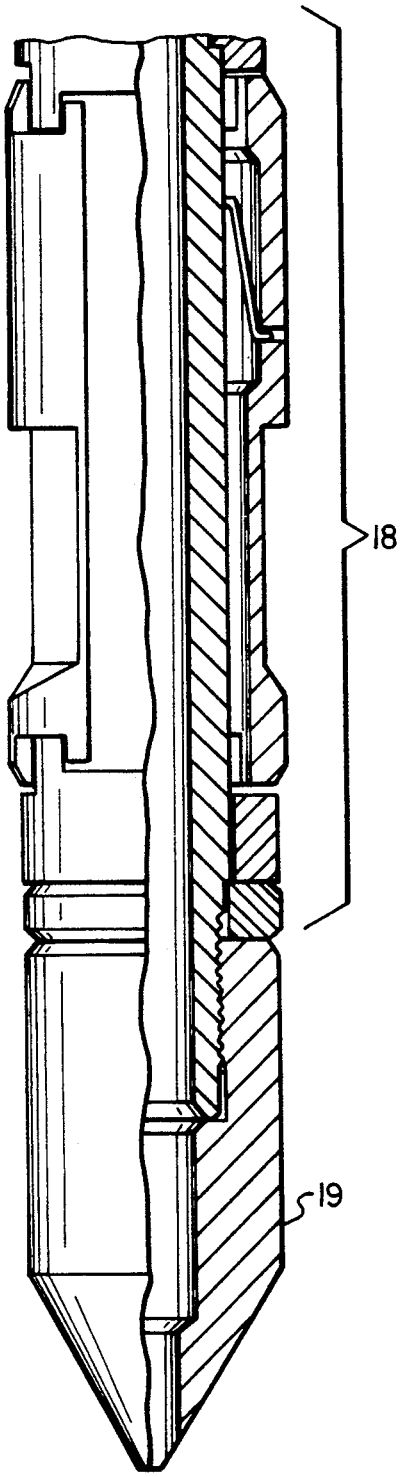

FIGS. 2A, 2B and 2C together show the construction of the lock mandrel 15 with a key selective locator device 18 connected to the lower end of the lock mandrel. A guide nose 19 is connected to the lower end of locator 18.

FIG. 6 shows a no-go locator 36 with a guide nose 19 connected on the lock mandrel.

Lock mandrel 15 has a connector 20 with an appropriate thread for connection to the lower end of the reeled tubing. The connector is connected to lock mandrel body 21 and sealed to it with resilient seal 22. Slidably mounted in seal bore 21*a* in the lock mandrel is a piston 23, which is slidably sealed in the bore with resilient seal 24. A spring 25 is mounted around the rod portion of the piston and is compressed between the piston head and a washer 26, which is prevented from moving downwardly by a shoulder in the mandrel body. The piston rod portion is threadedly connected and sealed to expander 27 with resilient seal 28. The expander has an expanding surface 27*a* and a rod portion which is slidably sealed in packing mandrel 29 seal bore 29*a* with resilient seal 30.

Figure 3:
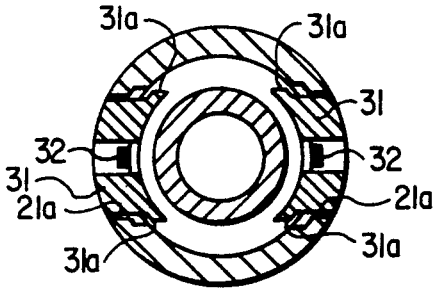
FIG. 3 is a cross sectional drawing along line 3—3 of FIG. 2.
Figure 4:
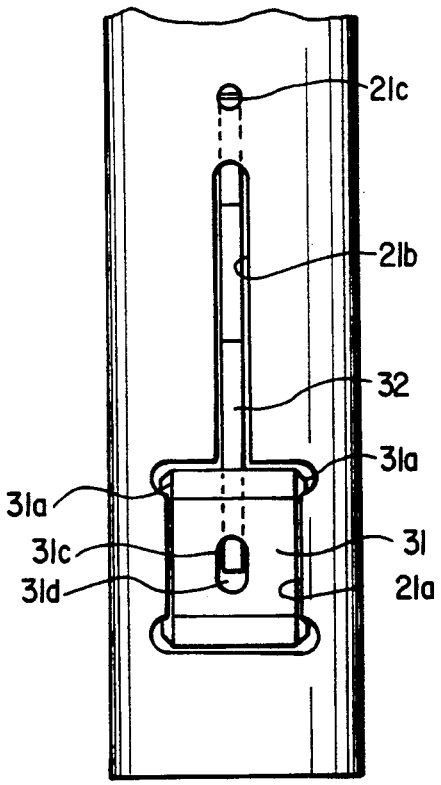
FIG. 4 is a fragmented drawing of the invention lock mandrel rotated 90° showing the locking lugs and leaf springs mounted in the lock mandrel body.

The mandrel body 21 has a pair of opposed openings 21*a*, slots 21*b* extending from the openings and holes 21*c* above each slot. A locking lug 31 is mounted for lateral movement in each opening. Each lug has ears 31*a* which prevent the lugs from falling out of the mandrel openings—see FIGS. 3 and 4. A leaf spring 32 is positioned in each hole 21*c* in mandrel body 21 and extends downwardly through slot 21*b*, inside lug groove 31*b*, across lug hole 31*c* and into outside lug groove 31*d*. Resilient seals 33 and appropriate packing adapters 34 for sealing pressure from above or below are mounted on the packing mandrel. A thread 35 is provided in the packing mandrel for connecting selective locater 18 or a nonselective locator 36. Either locator connected to the lock mandrel acts to retain the resilient seals 33 and adapters 34 on the packing mandrel.

To use the lock mandrel of this invention, a selective locator 18 or a nonselective locator 36 is attached and the lock mandrel is connected to reeled tubing and lowered down large well tubing or casing until the lock mandrel seals 33 are sealingly engaged in the seal bore of the landing nipple in which the locator has stopped downward movement of the lock mandrel with mandrel lugs 31 adjacent the landing nipple locking groove.

Figure 5A:
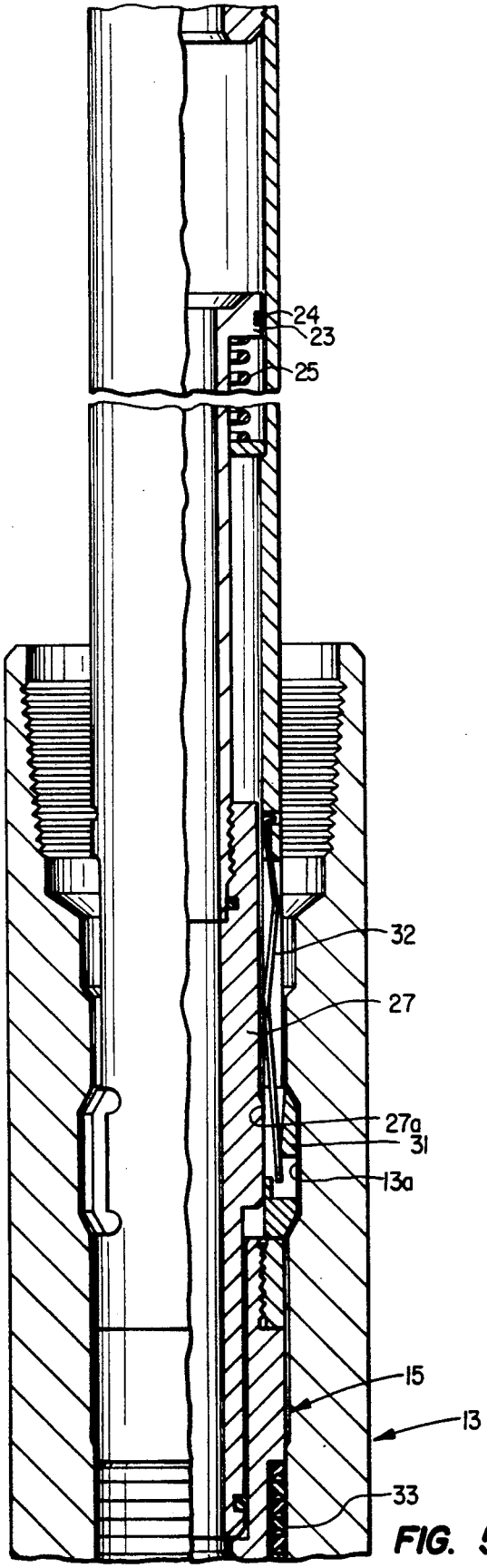
FIGS. 5A and 5B together are a sectioned drawing in elevation showing the hydraulically actuated lock mandrel of this invention located, with selective locator located sealingly engaged and locked in a selective landing nipple.
Figure 5B:
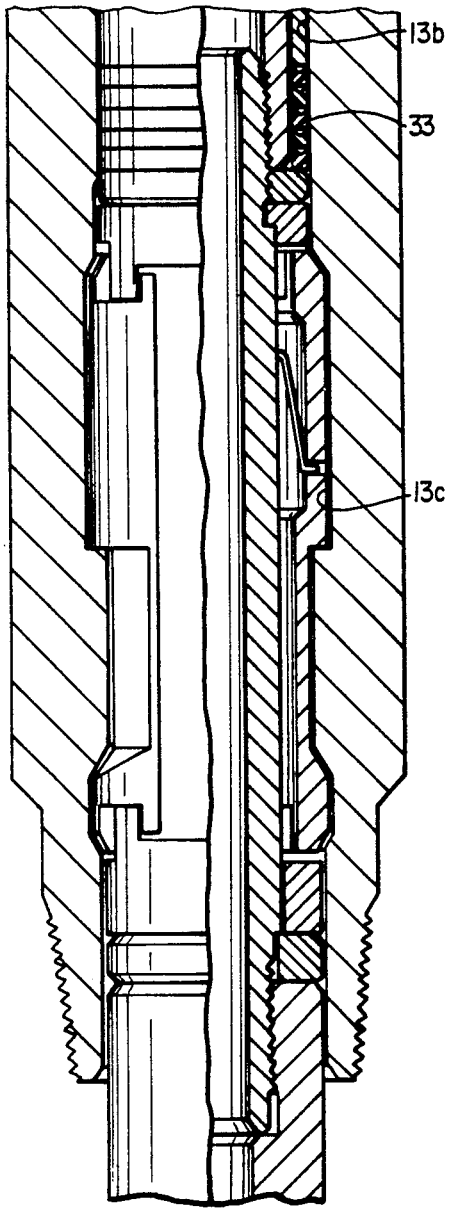

Sufficient pressure transmitted down small tubing 16 to the lock mandrel will act on piston resilient seal 24 and move piston 23 and expander 27 downwardly while compressing spring 25. As the expander moves downwardly in springs 32, the springs are cammed to swing outwardly and push lugs 31 into the landing nipple locking groove (13*a* in FIG. 5 or 14*a* in FIG. 6). As the expander moves to its lowermost position as shown in FIGS. 5 and 6, expander surface 27*a* moves inside lugs 31 locking them in expanded position in the landing nipple locking groove which connects the lock mandrel to the landing nipple and anchors the reeled tubing. This connection will be maintained as long s there is sufficient pressure in tubing 16 to overcome the upward force of compressed spring 25. Sufficient reduction of pressure in small tubing 16 will permit compressed spring 25 to automatically move piston 23 and expander 27 upwardly. Expander surface 27*a* moves from inside locking lugs 31 unlocking the lock mandrel from the landing nipple and permitting the leaf springs to move the lugs inwardly from the landing nipple locking groove. The mandrel and reeled tubing may now be retrieved from the wall.

I claim:

1. A locking mandrel for locking in a groove formed in a landing nipple disposed in well tubing, said mandrel comprising:

(a) a tubular housing having a longitudinal bore for receiving fluid and openings extending through its wall said housing having seals thereon sealingly engageable in said landing nipple;

(b) a laterally moveable lug member in each said opening;

(c) piston means disposed in said bore and adapted to move in a first direction in response to a predetermined fluid pressure in said bore;

(d) means for moving said piston means in a direction opposite said first direction when fluid pressure in said bore is less than said predetermined pressure; and (e) means including leaf springs mounted in said housing and engaging said lug members for moving in said housing and engaging said lug members for moving said lug members to expanded position in said groove on movement of said piston means in said first direction, said springs moving said lug members to said retracted position on movement of said piston means in said opposite direction.

2. The mandrel of claim 1 wherein the piston means comprise:

(a) a piston slidably sealed in the housing, said piston having a rod portion; and (b) an expander sealably connected to said rod portion and slidably sealed in said housing below the housing openings, said expander engageable with the leaf springs for moving the lug members to expanded position.

3. The mandrel of claim 2 wherein the means for moving the piston in the opposite direction is a coil spring extending around the rod portion between said piston and a shoulder in the housing.

4. A locking mandrel for locking in a groove formed in a landing nipple in well tubing, said mandrel comprising:

(a) a tubular housing having a longitudinal bore for receiving fluid and openings extending through its wall, said housing having seals thereon sealingly engageable in said landing nipple;

(b) a laterally moveable lug member in each said opening;

(c) piston means disposed in said bore and adapted to move in a first direction in response to a predetermined fluid pressure in said bore, said piston means including a piston slidably sealed in said housing, said piston having a rod portion and an expander sealably connected to said rod portion and slidably sealed in said body below said housing openings, said lug members moveable from retracted position to expanded position in said groove in response to movement of said piston and expander in said first direction;

(d) a coil spring extending around said rod portion for moving said piston and expander in a direction opposite said first direction when fluid pressure in said bore is less than said predetermined pressure; and (e) leaf springs mounted in said housing, each said spring pivotally engaging a lug member for moving said lug members to expanded position on movement of said piston and expander in said first direction, said springs moving said lug members to said retracted position on movement of said piston and expander in said opposite direction.

* * * * *